US011106170B2

(12) United States Patent
Kamada

(10) Patent No.: US 11,106,170 B2
(45) Date of Patent: Aug. 31, 2021

(54) IMAGE FORMING APPARATUS HAVING DOUBLE-SIDED CONVEYANCE PATH FOR FORMING IMAGE ON BOTH SIDES OF SHEET

(71) Applicant: CANON KABUSHIKI KAISHA, Tokyo (JP)

(72) Inventor: Naoki Kamada, Noda (JP)

(73) Assignee: Canon Kabushiki Kaisha, Tokyo (JP)

( * ) Notice: Subject to any disclaimer, the term of this patent is extended or adjusted under 35 U.S.C. 154(b) by 335 days.

(21) Appl. No.: 16/196,350

(22) Filed: Nov. 20, 2018

(65) Prior Publication Data

US 2019/0155201 A1 May 23, 2019

(30) Foreign Application Priority Data

Nov. 20, 2017 (JP) ..... JP2017-223054

(51) Int. Cl.
*G03G 15/00* (2006.01)
*G03G 15/16* (2006.01)
*G03G 15/23* (2006.01)

(52) U.S. Cl.
CPC ..... *G03G 15/6511* (2013.01); *G03G 15/1615* (2013.01); *G03G 15/234* (2013.01); *G03G 15/602* (2013.01)

(58) Field of Classification Search
CPC .. G03G 15/6561; G03G 15/23; G03G 15/234; G03G 15/6579; G03G 15/6511; G03G 15/1615; G03G 15/602; B65H 2301/33312; B65H 2403/72; B65H 2404/143; B65H 5/062; B65H 5/26; B65H 9/006; B65H 29/60; B65H 85/00; B65H 2404/144
See application file for complete search history.

(56) References Cited

U.S. PATENT DOCUMENTS 10,642,211 B2 * 5/2020 Deno ..... G03G 15/6561
2002/0061215 A1 * 5/2002 Kamei ..... G03G 15/234 399/401
2010/0296856 A1 * 11/2010 Moriyama ..... B65H 5/062 400/642
2013/0142526 A1 * 6/2013 Numazu ..... G03G 15/2039 399/21

(Continued)

FOREIGN PATENT DOCUMENTS

JP 2002-365862 A 12/2002
JP 5720438 B2 5/2015

*Primary Examiner* — David H Banh
(74) *Attorney, Agent, or Firm* — Venable LLP

(57) ABSTRACT

An image forming apparatus includes an image forming unit configured to form an image on a sheet; a first roller configured to feed a sheet, on one surface of which an image was formed by the image forming unit, to a double-sided conveyance path for forming an image on another surface opposite to the one surface of the sheet; a second roller positioned downstream of the first roller in a conveyance direction of the double-sided conveyance path; a third roller positioned downstream of the second roller in the conveyance direction; a fourth roller positioned downstream of the third roller in the conveyance direction; a first driving unit configured to drive the first roller and the second roller; and a second driving unit configured to drive the third roller and the fourth roller.

9 Claims, 14 Drawing Sheets

(56) References Cited

U.S. PATENT DOCUMENTS

2015/0015656 A1* 1/2015 Moriyama ..... B41J 11/04
347/110
2016/0091838 A1* 3/2016 Mizuno ..... G03G 15/1615
399/167

* cited by examiner

IMAGE FORMING APPARATUS HAVING DOUBLE-SIDED CONVEYANCE PATH FOR FORMING IMAGE ON BOTH SIDES OF SHEET

BACKGROUND OF THE INVENTION

Field of the Invention

The present invention relates to an image forming apparatus for forming an image on a sheet.

Description of the Related Art

There are image forming apparatuses that can form an image on both sides of a sheet. Such image forming apparatuses provide a double-sided conveyance path for sending a sheet, on one side of which an image was formed, back to a position for forming an image on the sheet again. The conveyance direction of a sheet on one side of which an image was formed is reversed in a reversing region, and the sheet is fed to the double-sided conveyance path. Japanese Patent No. 5720438 discloses a configuration such that it is possible to arrange three A4 size, which is a comparatively short size, sheets in the reversing region and the double-sided conveyance path, and efficiently circulate the sheets. Japanese Patent Laid-Open No. 2002-365862 discloses a configuration of controlling the interval between sheets in accordance with the length of the sheet circulation path including the double-sided conveyance path.

The configuration of Japanese Patent No. 5720438 presumes the same number of motors (driving units) as the number of sheets that can be arranged on the reversing region and the double-sided conveyance path. Here, it is desired that the cost of the image forming apparatus be restrained and the cost of the sheet conveyance configuration be restrained.

SUMMARY OF THE INVENTION

According to an aspect of the present invention, an image forming apparatus includes an image forming unit configured to form an image on a sheet; a first roller configured to feed a sheet, on one surface of which an image was formed by the image forming unit, to a double-sided conveyance path for forming an image on another surface opposite to the one surface of the sheet; a second roller positioned downstream of the first roller in a conveyance direction of the double-sided conveyance path; a third roller positioned downstream of the second roller in the conveyance direction of the double-sided conveyance path; a fourth roller positioned downstream of the third roller in the conveyance direction of the double-sided conveyance path; a first driving unit configured to drive the first roller and the second roller; and a second driving unit configured to drive the third roller and the fourth roller.

Further features of the present invention will become apparent from the following description of exemplary embodiments with reference to the attached drawings.

DESCRIPTION OF THE EMBODIMENTS

Exemplary embodiments of the present invention will be described hereinafter, with reference to the drawings. Note, the following embodiments are examples and the present invention is not limited to the content of the embodiments. Also, in the following figures, elements that are not necessary in the explanation of the embodiment are omitted from the figure.

First Embodiment

Figure 1:
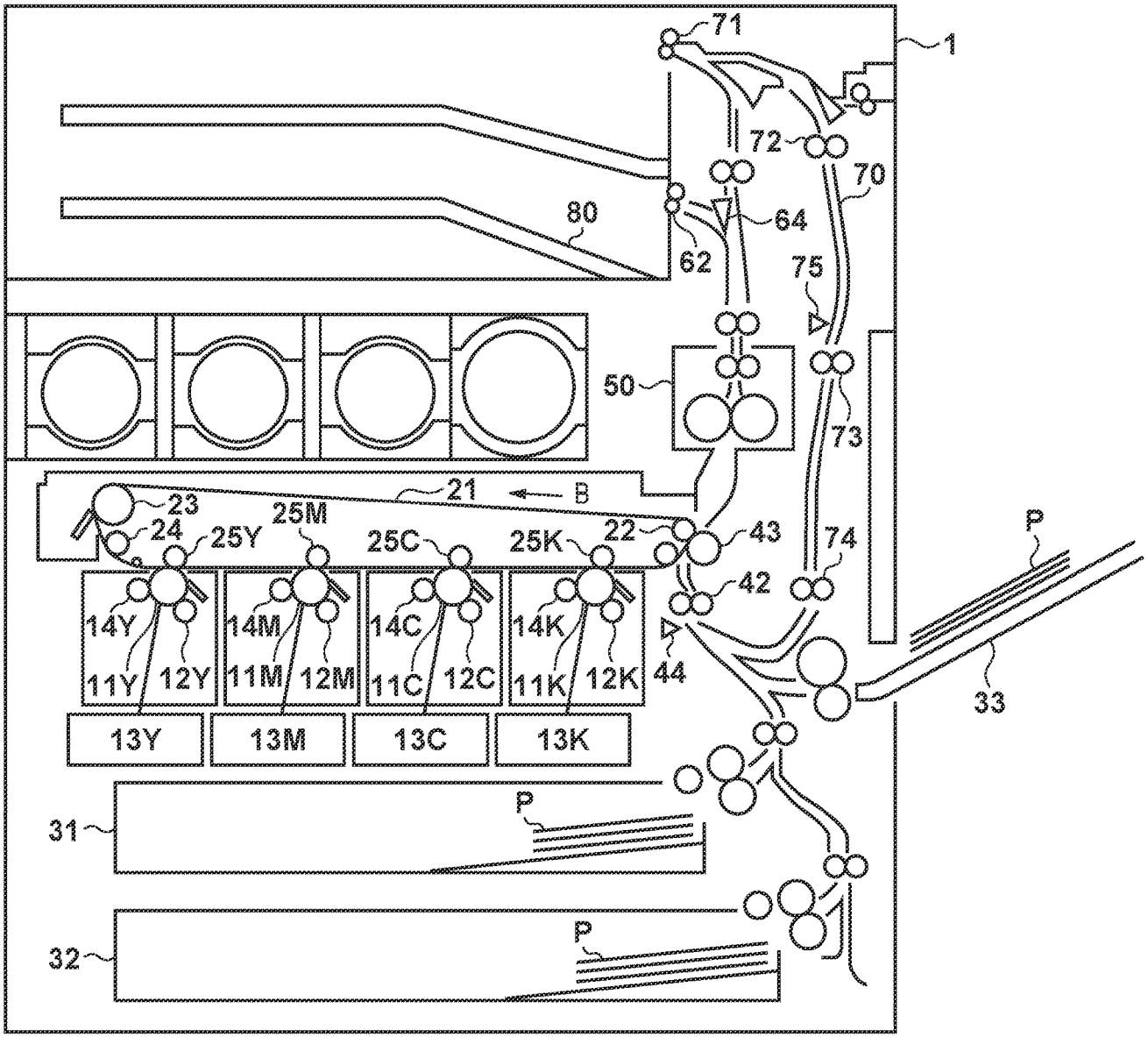
FIG. 1 is a configuration diagram of an image forming apparatus according to an embodiment.

FIG. 1 is a configuration diagram of an image forming apparatus 1 according to this embodiment. Note that in FIG. 1, the letters Y, M, C, and K at the end of reference numerals indicate that the color of the toner image for forming by a corresponding member is yellow, magenta, cyan, and black, respectively. However, in the following description, in a case there is no need to distinguish colors, a reference numeral with the letter removed from the end will be used. A charging apparatus 12 charges an obverse side of a photosensitive body 11 which is an image carrying body. An exposure apparatus 13 exposes the photosensitive body 11 and forms a latent image on the photosensitive body 11. A developing apparatus 14 develops a latent image of the photosensitive body 11 by toner, and forms a toner image on the photosensitive body 11. A primary transfer apparatus 25 outputs a primary transfer bias and transfers to an intermediate transfer belt 21 the toner image of the photosensitive body 11. Note that by transferring the toner images of each of the photosensitive body 11 overlappingly on the intermediate transfer belt 21, a full-color toner image is formed on the intermediate transfer belt 21. The intermediate transfer belt 21 is stretched by a driving roller 23, a tension roller 24, and a secondary inner transfer roller 22, and when forming an image is rotatably driven in the direction of the arrow B. Accordingly, a toner image that was transferred to the intermediate transfer belt 21 is conveyed to a position opposite a secondary transfer roller 43.

A sheet P stored in a sheet storage case 31 or 32 or a sheet P stacked on a manual feed tray 33 is fed to a conveyance path and conveyed to a registration roller 42. Note that at this time the sheet P abuts the registration roller 42 which has stopped and is put in a loop state, and consequently, skewing of the sheet P is corrected. The registration roller 42 conveys the sheet P so that the sheet P reaches the position opposite the secondary transfer roller 43 at a timing at which the toner image on the intermediate transfer belt 21 reaches the position opposite the secondary transfer roller 43. The secondary transfer roller 43 outputs a secondary transfer bias, and transfers the toner image on the intermediate transfer belt 21 to the sheet P. The position of the secondary transfer roller 43 is a position at which an image is formed on a sheet. The sheet P, after the toner image is transferred thereto, is conveyed to a fixing apparatus 50, and the fixing apparatus 50 heats/pressurizes the sheet P, and thereby the toner image is fixed to the sheet P.

In the case where an image is formed on only one side (a first surface) of the sheet P, a flapper 64 is set to a position for conveying the sheet P to the side of a discharge roller 62. With this, the sheet P is discharged to a sheet discharge tray 80. Meanwhile, in the case where images are to be formed on both sides (a first surface and a second surface) of the sheet P, the flapper 64 is set to a position for conveying the sheet P, after an image is formed on the first surface, towards a reversing roller 71. When the trailing end portion of the sheet P is nipped by the reversing roller 71, the rotation direction of the reversing roller 71 is reversed. With this, the sheet P is sent to a double-sided conveyance path 70. In the double-sided conveyance path 70, the sheet P is conveyed by double-side rollers 72, 73, and 74 to a position opposite the secondary transfer roller 43 once again via the registration roller 42, image formation to the second surface which is the opposite surface of the first surface is performed. The sheet P, after images are formed on both sides thereof, is discharged to the sheet discharge tray 80 after a fixing process by the fixing apparatus 50. Note that a double-sided sensor 75 is provided on the upstream side of the double-sided roller 73 of the double-sided conveyance path 70. Also, on the upstream side of the registration roller 42, a registration sensor 44 is provided.

Figure 2:
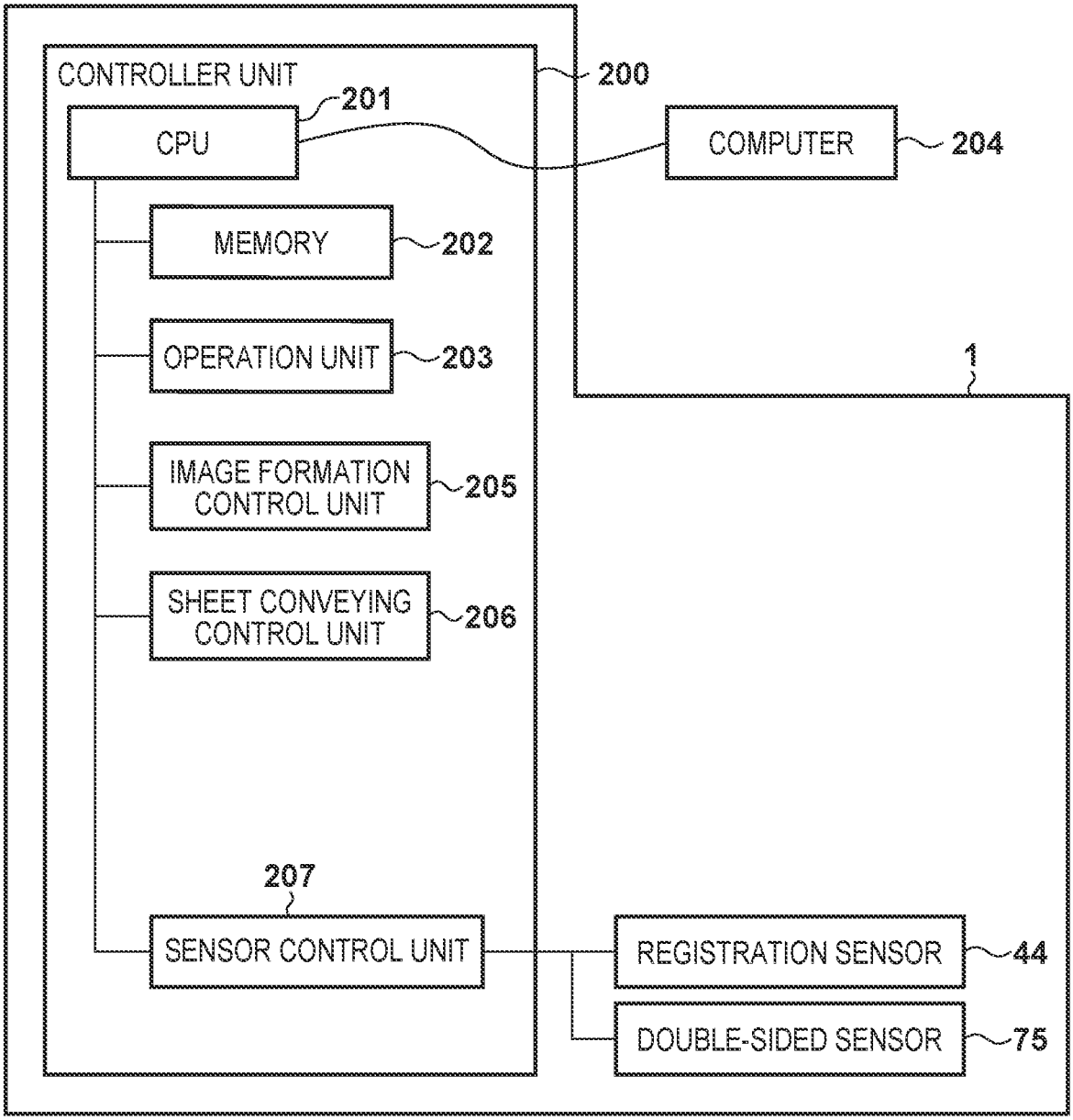
FIG. 2 is a block diagram of an image forming apparatus according to an embodiment.

FIG. 2 illustrates a control configuration of the image forming apparatus 1. A CPU 201 of a controller 200 controls the image forming apparatus 1 by executing a control program. A memory 202 includes a RAM and a ROM, and stores a control program and various data. An operation unit 203 provides a user interface. A user operates the image forming apparatus 1 by using the operation unit 203, and the operation unit 203 provides information necessary for the user to operate the image forming apparatus 1. An image formation control unit 205 controls formation of a toner image on the photosensitive body 11, transfer of a toner image to the intermediate transfer belt 21, and transfer of a toner image to the sheet P. A sheet conveying control unit 206 controls conveyance of the sheet P. A sensor control unit 207 controls each sensor including the registration sensor 44 and the double-sided sensor 75, and receives the result of detection by each sensor. Note that the image forming apparatus 1 can receive various information related to a sheet used for printing from a computer 204 connected via a network, for example.

Figure 3A:
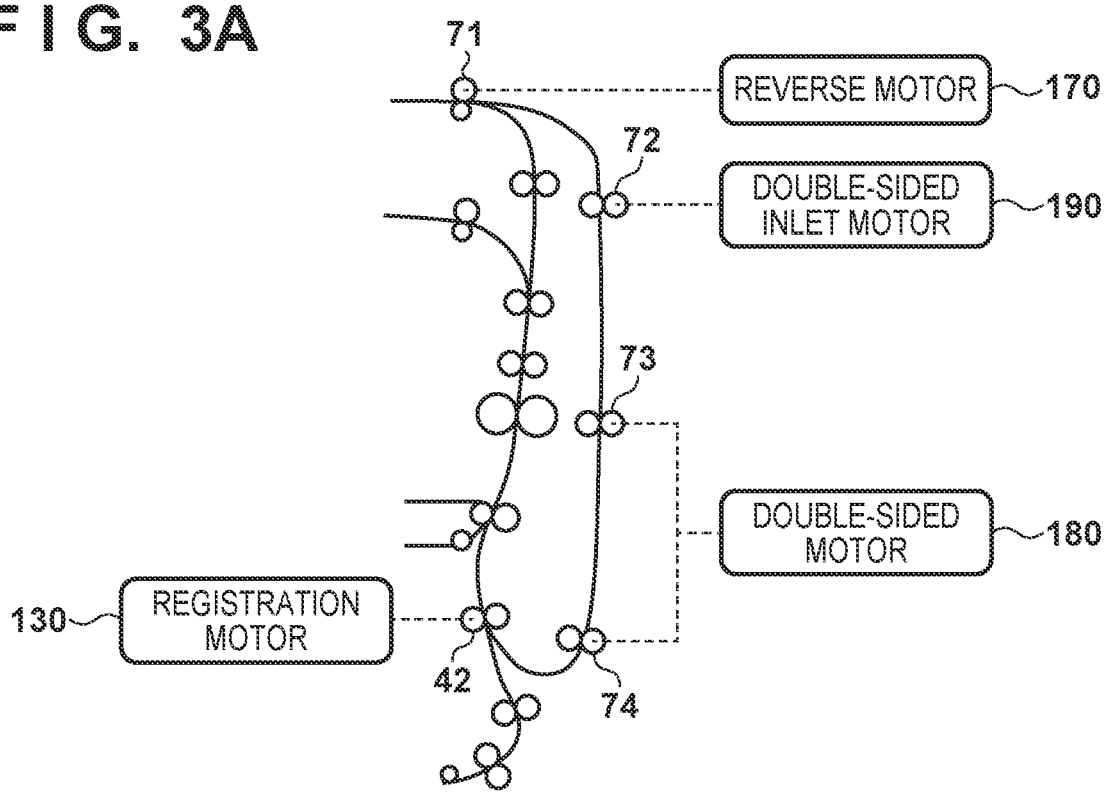
FIGS. 3A and 3B are views which illustrate a conveyance configuration according to an embodiment.
Figure 3B:
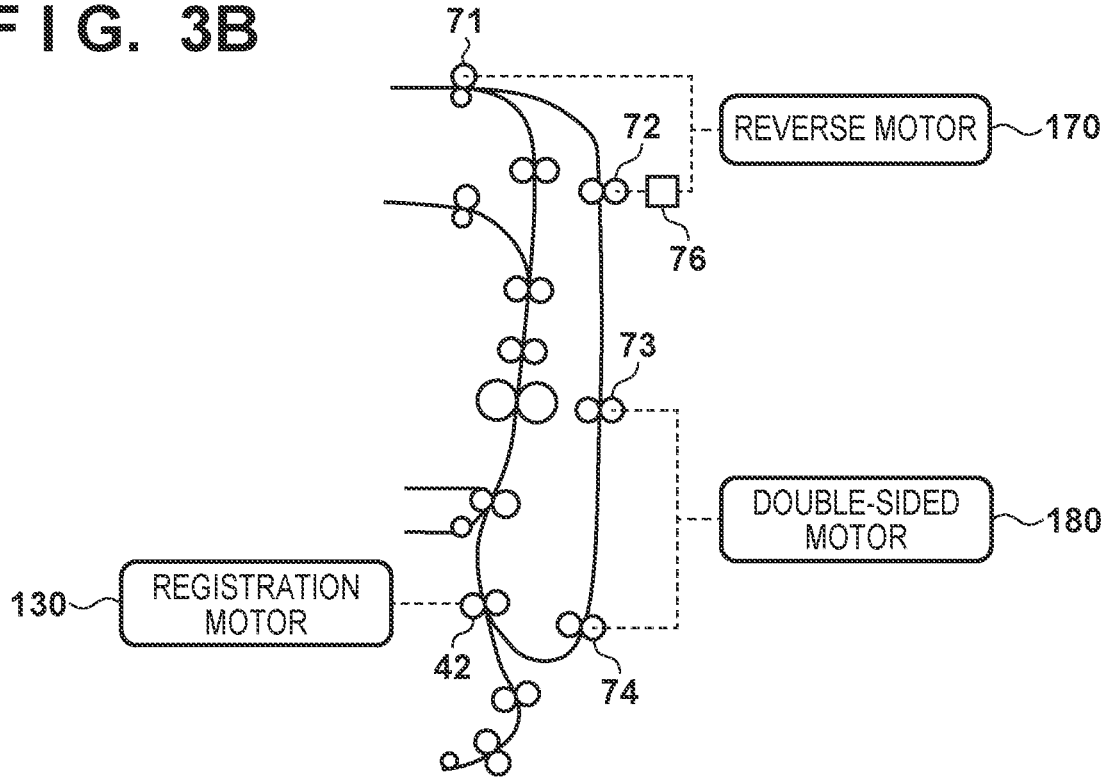

FIG. 3A indicates a conventional sheet conveyance control configuration, and FIG. 3B indicates a sheet conveyance control configuration according to this embodiment. Note that in FIG. 3A and FIG. 3B, description will be given assigning reference numerals only to the rollers necessary for the description of the present embodiment and the motors which are the driving units for driving those rollers. Meanwhile, rollers that are not necessary in the description of the present embodiment are shown graphically but description thereof is omitted. In the configuration of FIG. 3A, the reversing roller 71 is driven by a reverse motor 170, and the double-sided roller 72 is driven by the double-sided inlet motor 190. Furthermore, the double-sided rollers 73 and 74 are driven by a double-sided motor 180 and the registration roller 42 is driven by a registration motor 130. Meanwhile, in the present embodiment, the configuration is different from what is conventional in that the double-sided inlet motor 190 is not used and instead the reverse motor 170 drives the double-sided roller 72. Note that in the middle of a drive transmission path from the reverse motor 170 to the double-sided roller 72, a one-way clutch 76, which is a driving force blocking unit for blocking a driving force, is provided. The one-way clutch 76 transfers the driving force for conveying a sheet in the conveyance direction of the double-sided conveyance path 70 to the double-sided roller 72. Meanwhile, the one-way clutch 76 does not transfer the driving force for conveying a sheet in the direction opposite to the conveyance direction of the double-sided conveyance path 70 to the double-sided roller 72.

In normal image forming operation, sheets are conveyed at predetermined intervals (hereinafter referred to as image formation intervals), and image formation is performed on a sheet. The image formation interval determines the number of images formed per unit time, in other words the productivity. Here, for various reasons, the image formation interval may become longer, and the productivity may deteriorate. For example, when the temperature of the fixing apparatus 50 is too high, it is necessary to lengthen the image formation interval in order to cool down the fixing apparatus 50. Also, when the processing time in the controller 200 with respect to image data transferred from the computer 204 becomes longer, it is necessary to lengthen the image formation interval. Here, there are cases where it is necessary to determine whether or not it is necessary to delay image formation immediately prior to starting exposure by the exposure apparatus 13. Also, it is required that a time-lag from when image write is permitted until when exposure is started be as short as possible. This is because it is desirable to minimize the time to output the sheet. Accordingly, in the case where image write permission has not been given, the sheet P is stopped at the registration roller 42, and the time from when image write is permitted until when an image is formed on a sheet is shortened.

Figure 4A:
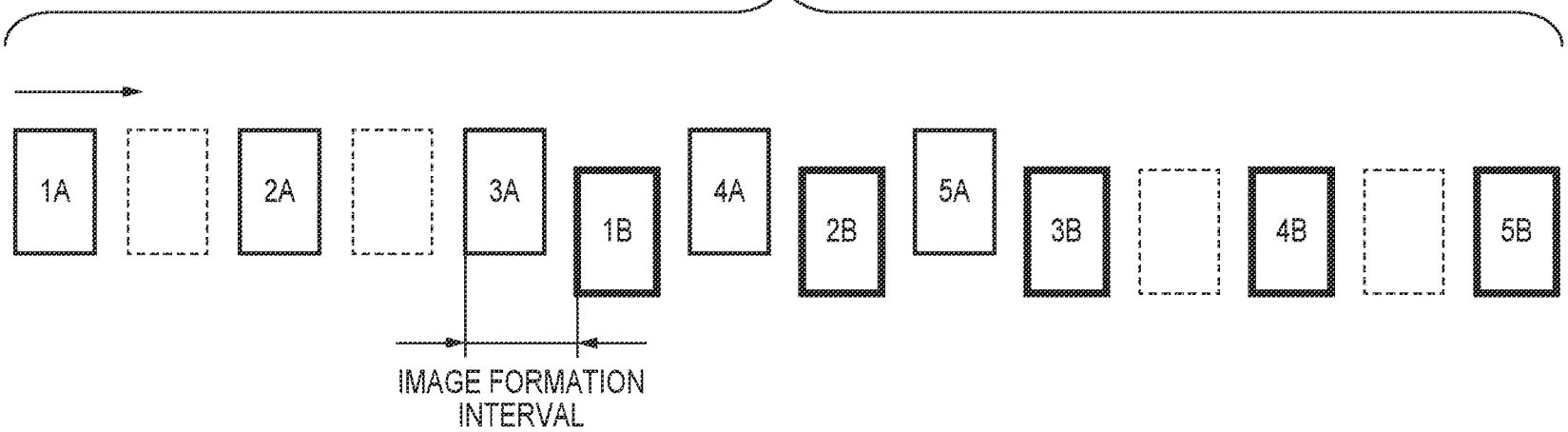
FIGS. 4A and 4B are views for describing an image formation order at a time of a double-sided circulation according to an embodiment.
Figure 4B:
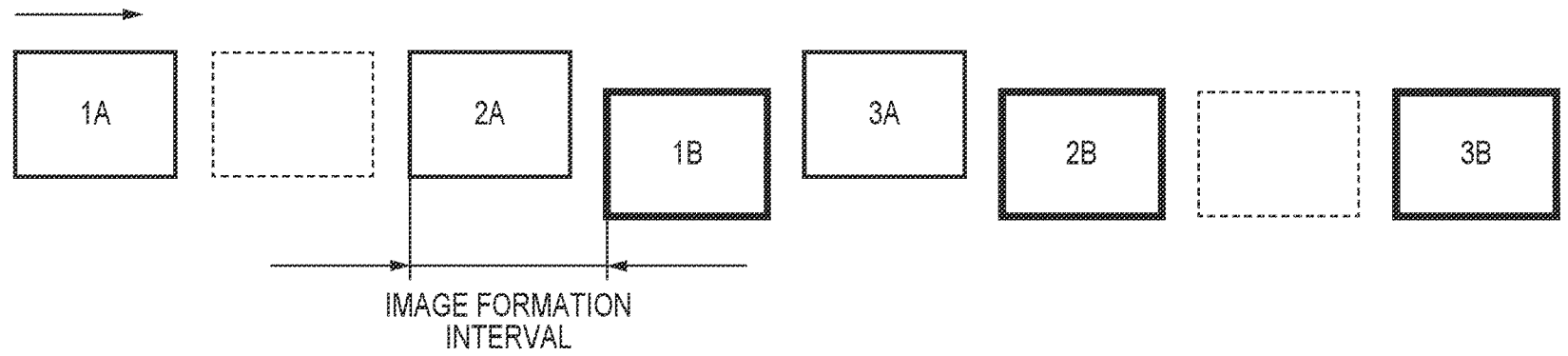

FIG. 4A and FIG. 4B illustrate an order in which images are formed when forming images on both sides of sheets. Note that FIG. 4A indicates a case where the sheets are of a small size (A4 or letter) and FIG. 4B indicates a case where sheets are of a large size (A3 or ledger). Note that the numerals are the sheet number (feed order), and the letter A indicates a first surface (obverse side) of the sheet on which an image is formed, and the letter B indicates a second surface (back side) of the sheet on which an image is formed. As is illustrated in FIG. 4A and FIG. 4B, in double-sided printing, there are segments in which image formation to a first surface and image formation to a second surface is performed alternatingly, and the intervals between sheets that are for alternatingly performing image formation to the first surface and image formation to the second surface are image formation intervals. Here, the image formation intervals are normally a fixed interval. Note that in the present embodiment, the small size is a size for which three sheets can be stopped in a conveyance path that is from the reversing roller 71 to the reversing roller 71 again via the double-sided rollers 72, 73 and 74 and the registration roller 42, and is for example, the A4 size. The large size is a size for which three sheets cannot be stopped, and is for example the A3 size.

Figure 5B:
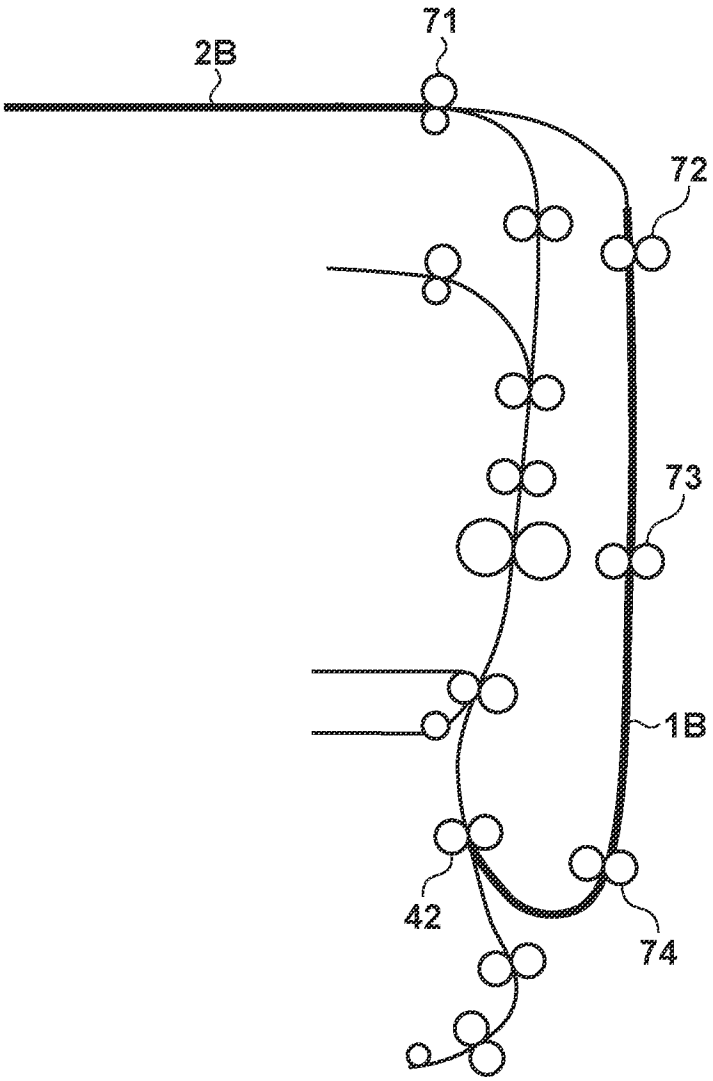
FIGS. 5A and 5B are sheet layout diagrams at a time of a double-sided circulation according to an embodiment.
Figure 5A:
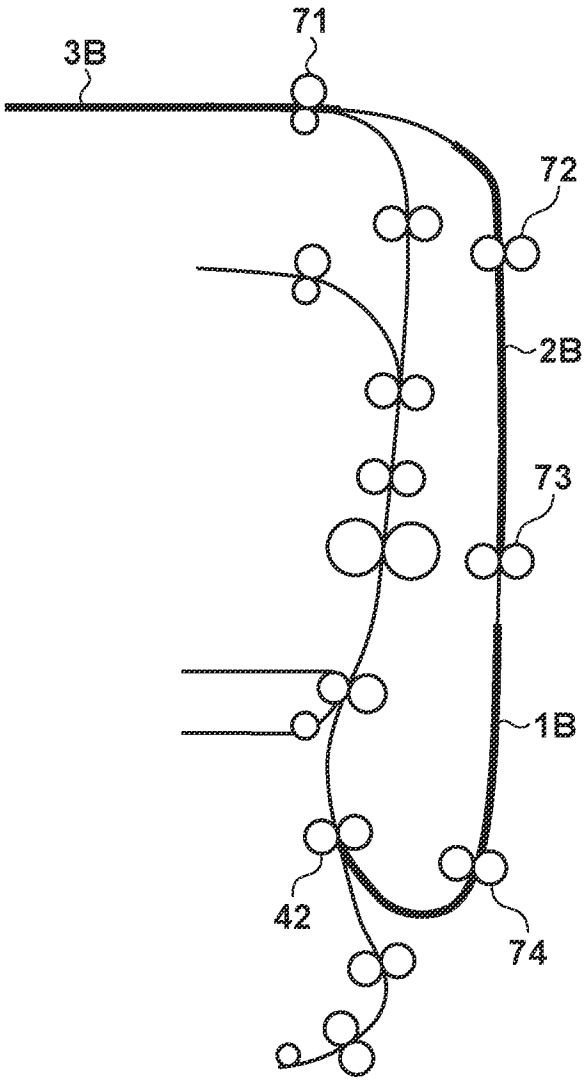

FIG. 4A illustrates the image forming order in the case where double-sided printing is performed on five small size sheets. As illustrated in FIG. 4A, first, an image is formed on the first surface of each of three sheets: 1A, 2A, and 3A. After that, images are formed alternatingly on the first surface and the second surface: the second surface of the first sheet, then the first surface of the fourth sheet, then the second surface of the second sheet. Also, after an image is formed on the second surface of the third sheet, images are formed on the second surfaces of the fourth and the fifth sheets. Here, one can consider a case in which writing of an image to be formed on the second surface of the first sheet, for example, is not permitted and the conveyance of the sheet 1B is stopped at the registration roller 42. In other words, a case where it is necessary to lengthen the image formation interval between sheet 3A and sheet 1B of FIG. 4A can be considered. By stopping the conveyance of the sheet 1B, it is necessary to also stop the conveyance of the sheet 2B and the sheet 3B, which are subsequent thereto in the double-sided conveyance path 70. FIG. 5A illustrates this state. According to FIG. 5A, the sheet 2B stops in the double-sided conveyance path 70 and the sheet 3B stops in the reversing region. Also, as described above, image write permission is performed immediately prior to the registration roller 42, and therefore it is necessary to first stop the sheet 1B and then stop the sheet 2B, and after that stop the sheet 3B, to thereby independently control the three sheets. To realize this, three motors, specifically the reverse motor 170, the double-sided inlet motor 190, and the double-sided motor 180, are provided in the conventional configuration illustrated in FIG. 3A. In contrast to this, only two motors, specifically the reverse motor 170 and the double-sided motor 180, are used in the present embodiment, as illustrated in FIG. 3B. Note that, as illustrated in FIG. 4B and FIG. 5B, with large size sheets, the number of sheets that can be stopped in the reversing region and the double-sided conveyance path 70 is two. It is clear that two motors are sufficient to control two sheets independently. Accordingly, hereinafter, description will be given for how to, with two motors, drive small size sheets, three of which can be stopped.

Figure 6:
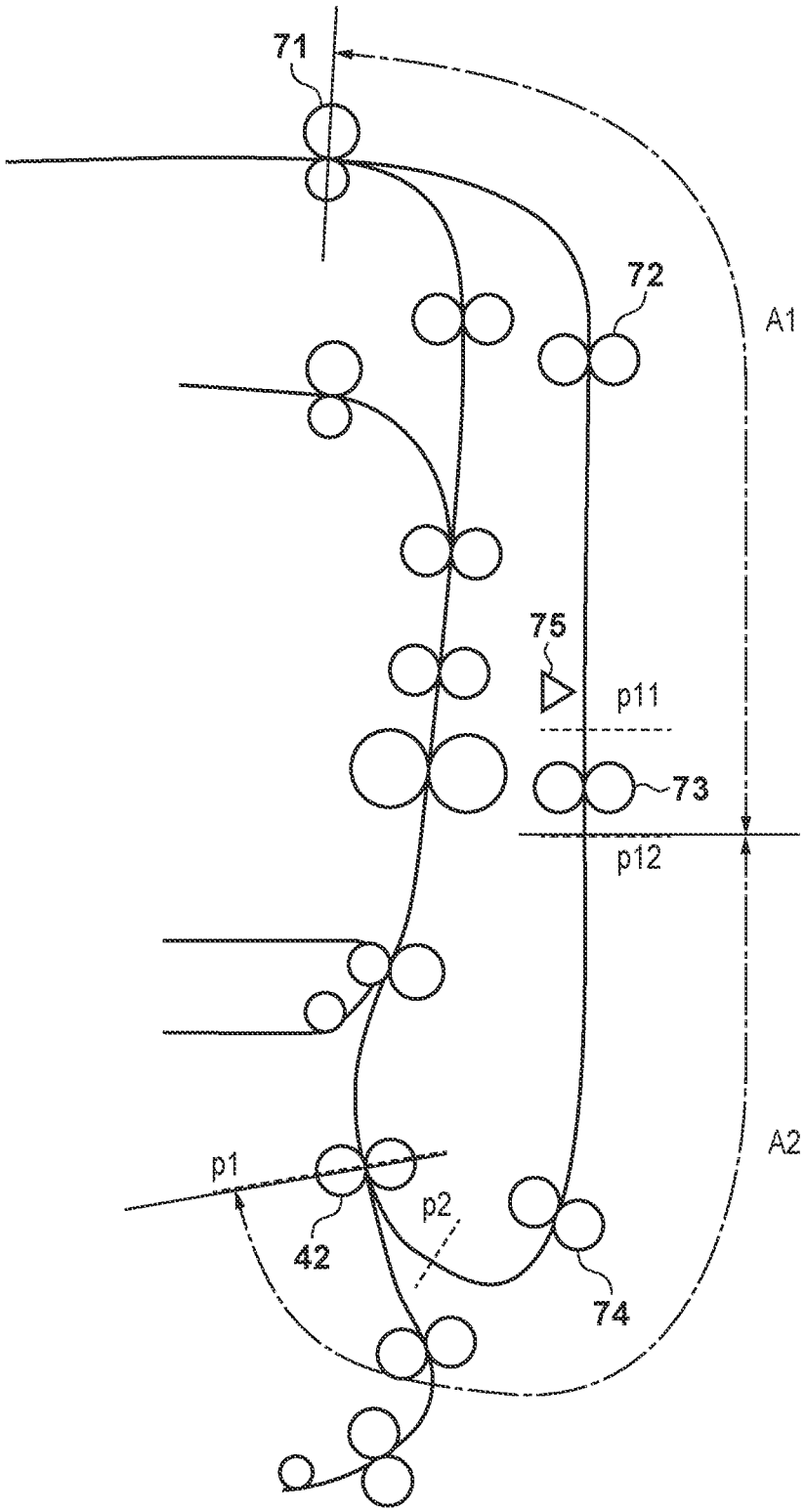
FIG. 6 is a view for describing each position which is defined on a conveyance path according to an embodiment.

FIG. 6 is a view for describing each position defined in the sheet conveyance control according to this embodiment. Firstly, a position of the registration roller 42 or a predetermined position on the upstream side of the registration roller 42 is made to be a first stop position p1. In the present embodiment, the position of the registration roller 42 is made to be the first stop position p1. A predetermined position on the upstream side of the first stop position p1 and on the downstream side of the double-sided roller 74 is made to be a second stop position p2. Also, a predetermined position on the upstream side of the double-sided roller 73 is made to be a double-sided motor drive start position p11. Furthermore, a predetermined position on the downstream side of the double-sided roller 73 and on the upstream side of the double-sided roller 74 is made to be an upstream stop position p12. Note that it will be described later how the first stop position p1, the second stop position p2, the double-sided motor drive start position p11, and the upstream stop position p12 are set. Furthermore, as illustrated in FIG. 6, a segment between the reversing roller 71 and the upstream stop position p12 is called an upstream stop section A1, and a segment between the upstream stop position p12 and the first stop position p1 is referred to as a downstream stop section A2.

Figure 7:
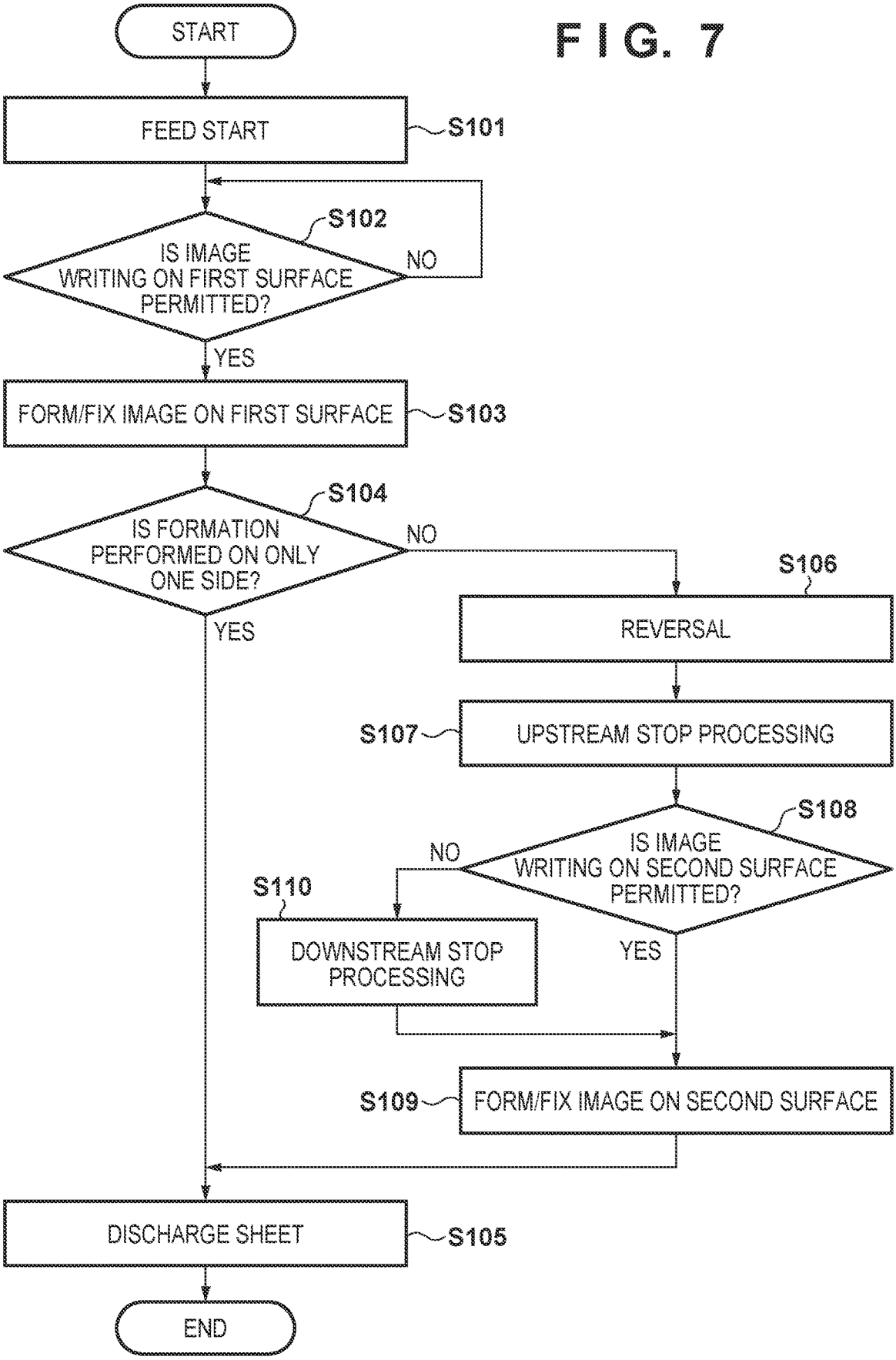
FIG. 7 is a flowchart of conveyance control according to an embodiment.

FIG. 7 is a flowchart for processing performed by the CPU 201 from feeding to discharging of a single sheet. The processing of FIG. 7 is started by a user executing a print job from the operation unit 203 of the image forming apparatus or the computer 204 which is connected to the image forming apparatus directly or via a network. Note that at this time, the user can designate sheet information of the sheets to use together with the number of copies to be printed. Focusing on the processing corresponding to a single sheet in a print job, in step S101, the CPU 201 starts a feed operation. As a result, a sheet is conveyed to the position of the registration roller 42. In step S102, the CPU 201 determines whether writing of an image to be formed on the first surface is permitted, and stops the conveyance of the sheet at the position of the registration roller 42 until writing is permitted. When write is permitted, the CPU 201, in step S103, performs image formation and a fixing process for the first surface. The CPU 201, in step S104, determines whether to form an image on only one side or to form images on both sides of the sheet. In the case of only one side, the CPU 201, in step S105, discharges the sheet to the sheet discharge tray 80. On the other hand, in the case of forming images on both sides, the CPU 201, in step S106, performs a reversal operation by the reversing roller 71, and conveys the sheet to the double-sided conveyance path 70. The CPU 201 performs upstream stop processing in step S107 on the sheet at the upstream stop section A1. Note that the upstream stop processing will be described later.

In step S108, the CPU 201 determines whether writing the image of the second surface is permitted, and if it is permitted, in step S109, performs image formation and a fixing process on the second surface. Meanwhile, when writing is not permitted, the CPU 201, in step S110, performs downstream stop processing on the sheet in the downstream stop section A2. Note that the downstream stop processing will be described later. After the downstream stop processing, the CPU 2014, in step S109, performs image formation and a fixing process for the second surface. Note that while a plurality of sheets is conveyed simultaneously, the CPU 201 executes the processing illustrated in FIG. 7 on each sheet individually.

Next, the upstream stop processing will be described using the flowchart of FIG. 8. First, the CPU 201, in step S201, determines whether a preceding sheet on which to perform image formation in advance of the upstream stop processing target sheet is stopped in the vicinity of the registration roller 42. If it is not stopped, the CPU 201 ends the upstream stop processing. On the other hand, if a preceding sheet is stopped in the vicinity of the registration roller 42, the CPU 201 determines in step S202 whether or not the leading end of the target sheet has reached the double-sided motor drive start position p11. Note that this determination is performed by the double-sided sensor 75 at a timing when the target sheet is detected. Note that instead of using the double-sided sensor 75, configuration may be taken to make the determination in accordance with the conveyance amount of the target sheet from when reversal was started. When the target sheet is determined to have reached the double-sided motor drive start position p11, the CPU 201, in step S203, issues a reach notification. This reach notification is used in downstream stop control that is described later. The CPU 201 after issuing the reach notification, in step S204, stands by for the time T1, and when the time T1 has elapsed, stops the reverse motor 170 in step S205. Also, while described later, the double-sided motor 180 is stopped at the same timing in the downstream stop processing as well at this time. The result of this is that the target sheet is nipped by the double-sided roller 73, and its leading end is stopped at the upstream stop position p12. Then, the CPU 201, in step S206, stands by in this state until writing of the image to be formed on the second surface of the preceding sheet is permitted. When it is permitted, driving of the double-sided motor 180 is started in later-described downstream stop processing, and conveyance of the target sheet is resumed.

Next, the downstream stop processing will be described using the flowchart of FIG. 9. First, the CPU 201, in step S301, determines whether there is a succeeding sheet following the target sheet of the downstream stop processing. When there is a succeeding sheet, the CPU 201, in step S302, determines whether the leading end of the target sheet reached the second stop position p2, and when the second stop position p2 has been reached, the double-sided motor 180 is stopped in step S303. After that, the CPU 201, in step S304, stands by until the succeeding sheet reaches the double-sided motor drive start position p11, and the reach notification is issued in the upstream stop processing for the succeeding sheet. When the reach notification is issued, the CPU 201, in step S305, starts driving of the double-sided motor 180. After that, the CPU 201, in step S306, stands by until the time T1 elapses, and when the time T1 elapses, in step S307, the double-sided motor 180 is stopped. This corresponds to step S204 and step S205 of the upstream stop processing in FIG. 8. At this time, the leading end of the target sheet is positioned at the first stop position p1.

Meanwhile, when, in step S301, it is determined that there is no succeeding sheet, the CPU 201, in step S310, conveys the target sheet until its leading end reaches the first stop position p1, and in step S307, stops the conveyance. The CPU 201, in step S308, stands by until writing of the image on the second surface of the target sheet is permitted, and when it is permitted, in step S309, starts driving of the double-sided motor 180. Thereby, the target sheet at the first stop position p1 is conveyed. Also, in the case where there is a succeeding sheet, the succeeding sheet is at the upstream stop position p12, and therefore it is also simultaneously conveyed by the double-sided roller 73.

Figure 8:
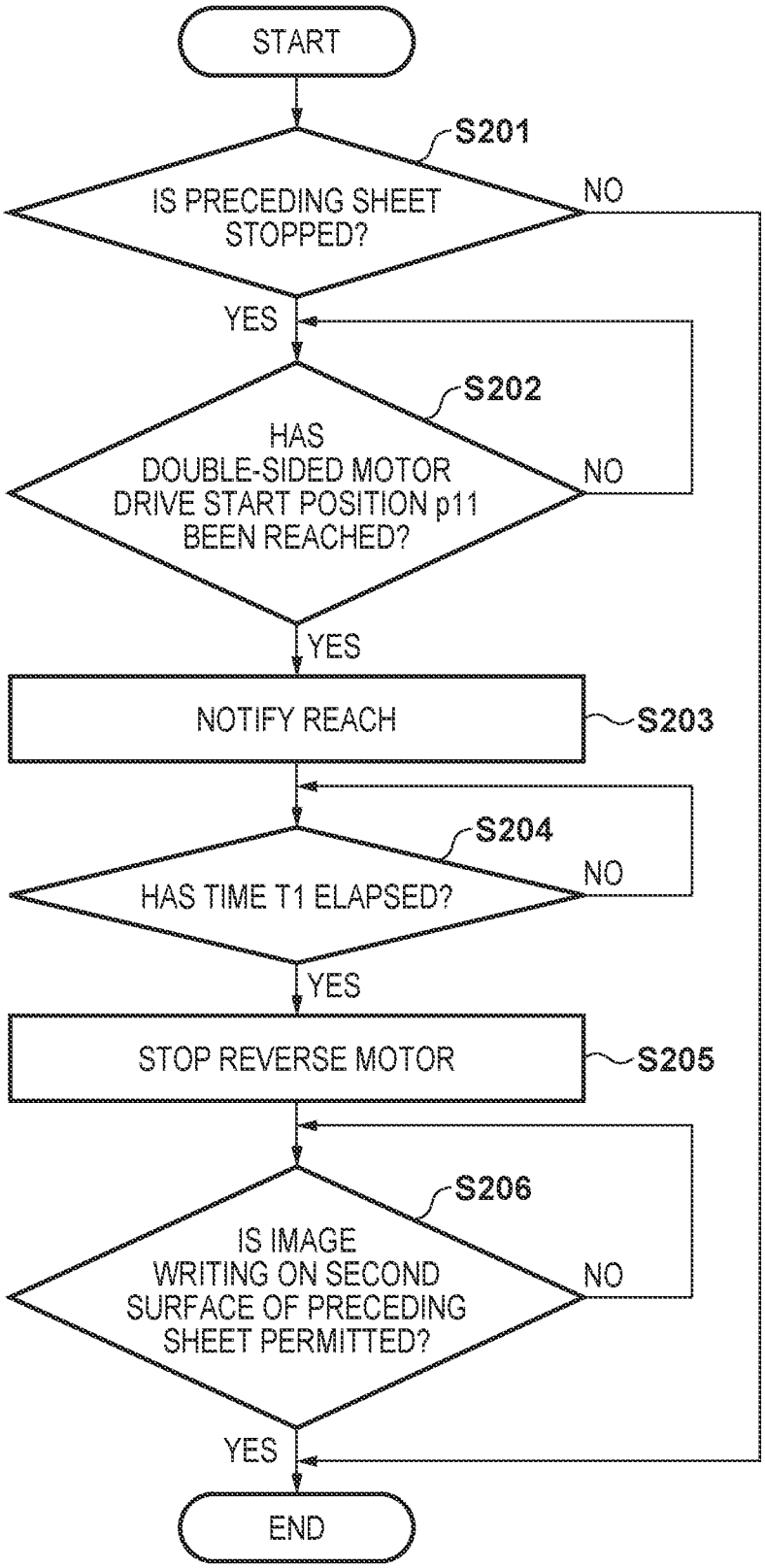
FIG. 8 is a flowchart of upstream stop processing according to an embodiment.
Figure 9:
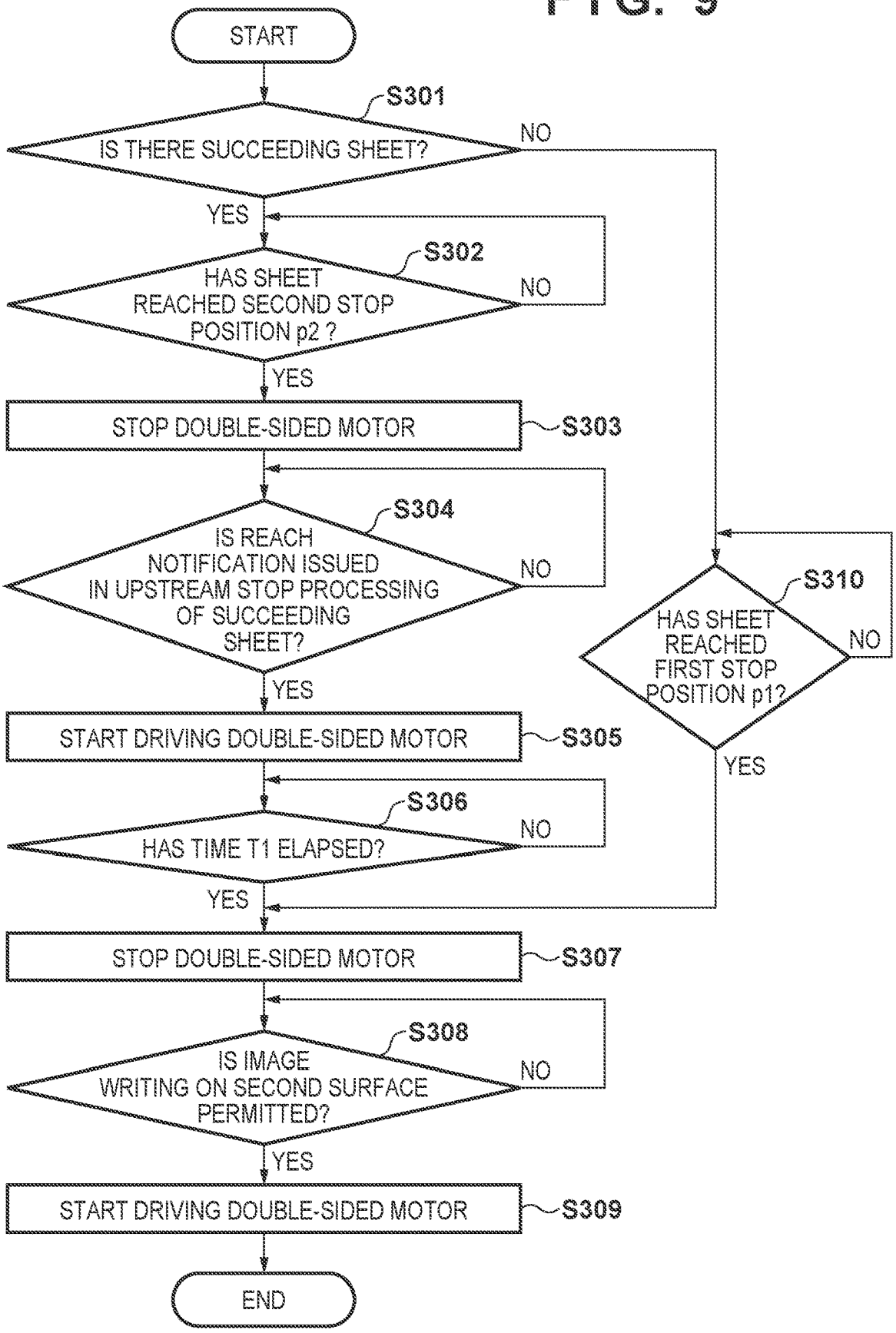
FIG. 9 is a flowchart of downstream stop processing according to an embodiment.
Figure 10B:
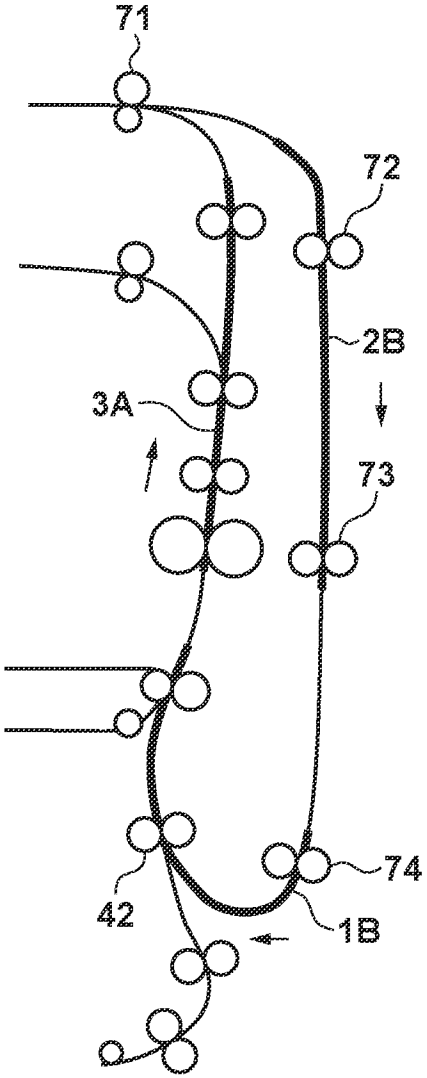
FIGS. 10A and 10B are views for describing a sheet conveyance when stop processing is not needed according to an embodiment.
Figure 10A:
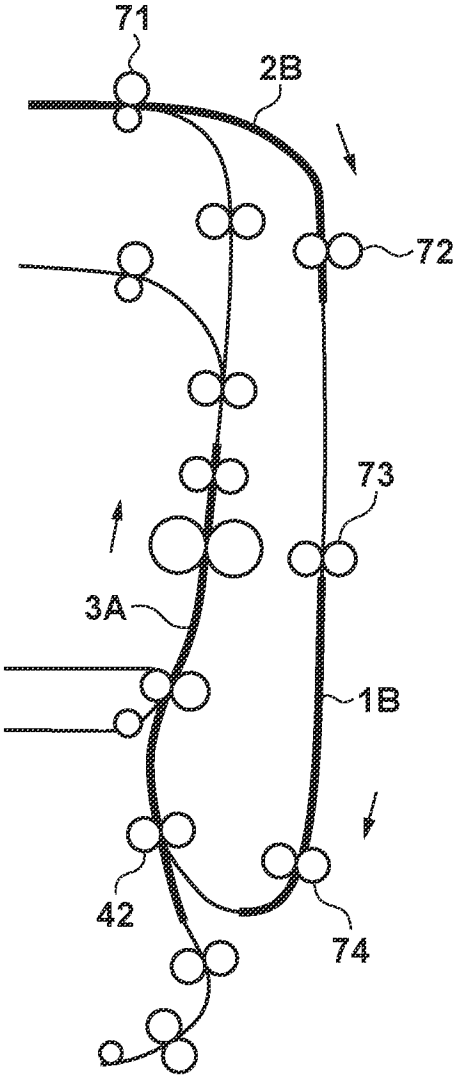
Figure 11:
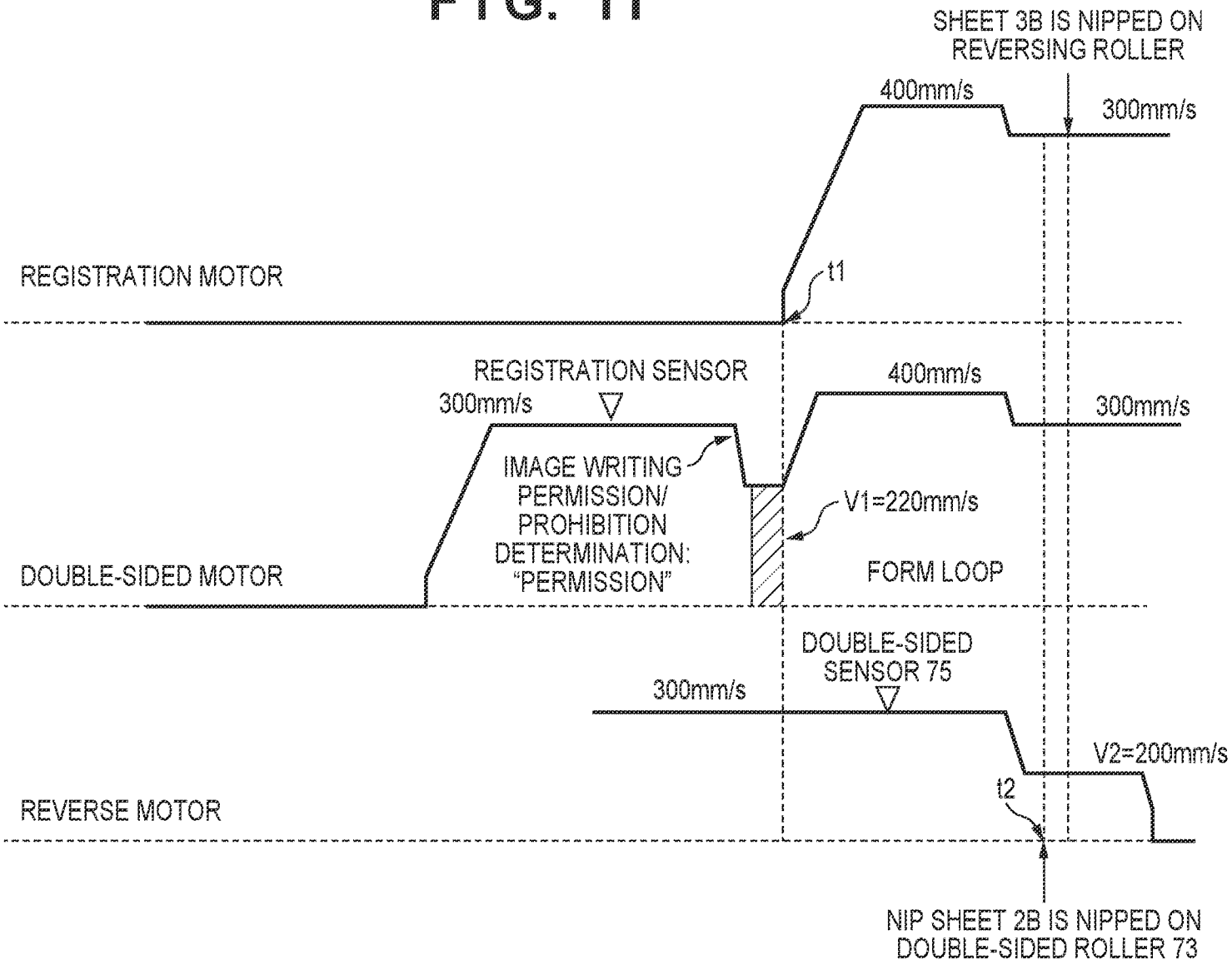
FIG. 11 is a motor driving line view of when stop processing is not needed according to an embodiment.

The detailed operation of the case of No in step S201 of FIG. 8 is described using FIG. 10A, FIG. 10B, and FIG. 11. After conveyance of preceding sheet 1B is stopped at a position upstream of the registration roller 42 in order to convey the sheet 3A as illustrated in FIG. 10A, the preceding sheet 1B is conveyed to the registration roller 42. Here, it is assumed that writing of the image of the second surface to the sheet 1B is permitted, and image formation to the sheet 1B is performed on the second surface as is. Accordingly, for the sheet 2B, No is determined in step S201 of FIG. 8, and as illustrated in FIG. 10B, conveyance of the sheet 2B is continued.

FIG. 11 illustrates the operation timing for the respective motors in the case where step S201 of FIG. 8 is No. Note that, the ordinate of the view indicates the conveyance speed by the motor, and the abscissa indicates the elapsed time. First, the operation for the preceding sheet 1B is described. The double-sided motor 180 conveys the sheet 1B at 300 mm/s. In the present embodiment, the loop forming speed V1 in the registration roller 42 according to the double-sided motor 180=220 mm/s, and after the registration sensor 44 detects the sheet 1B, the conveyance speed is reduced to V1 at a predetermined timing. In FIG. 11, the double-sided motor 180 is re-accelerated from time t1 without being stopped. Next, description will be given for the subsequent sheet 2B. By driving of the reverse motor 170, the sheet 2B at the double-sided roller 72 is conveyed. Also, when the double-sided sensor 75 detects the sheet 2B, in conformity with the sheet 2B being nipped by the double-sided roller 73, the CPU 201 reduces the conveyance speed according to the reverse motor 170 from 300 mm/s to V2=200 mm/s. At this time, the conveyance speed V2 according to the reverse motor 170 is 300 mm/s, which is the conveyance speed according to the double-sided motor 180, or less, and the sheet ends up being pulled away by the double-sided roller 74. Accordingly, it is possible to convey the sheet 1B and the sheet 2B by the double-sided motor 180. Also, since the one-way clutch is provided for the double-sided roller 72, it is possible to transition the reverse motor 170 into forward rotation operation from the reverse rotation so as to convey the sheet 3B by the reversing roller 71 in the direction opposite to the sheet 2B.

Figure 12A:
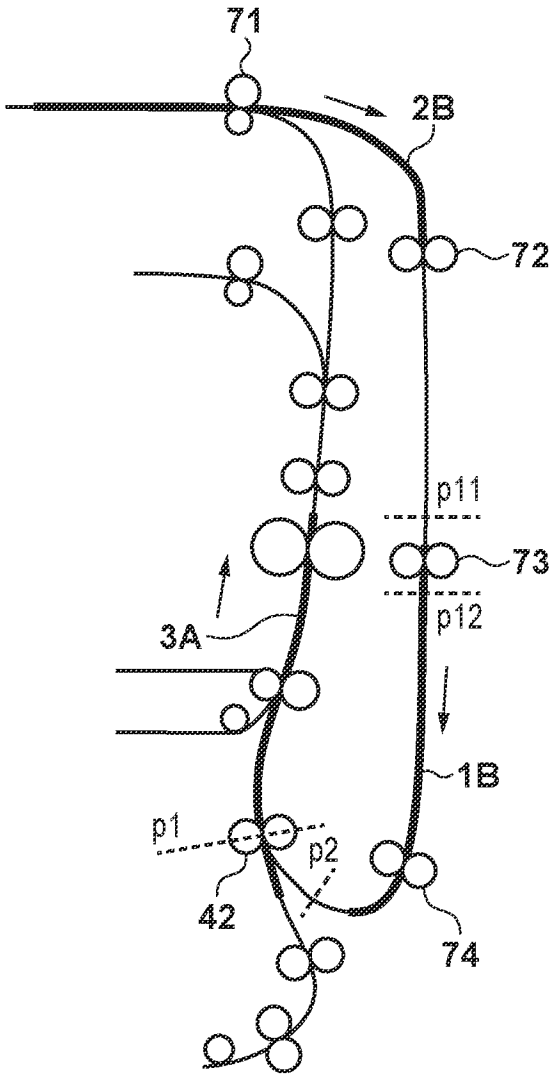
FIGS. 12A to 12C are views for describing a sheet conveyance when stop processing is needed according to an embodiment.
Figure 12B:
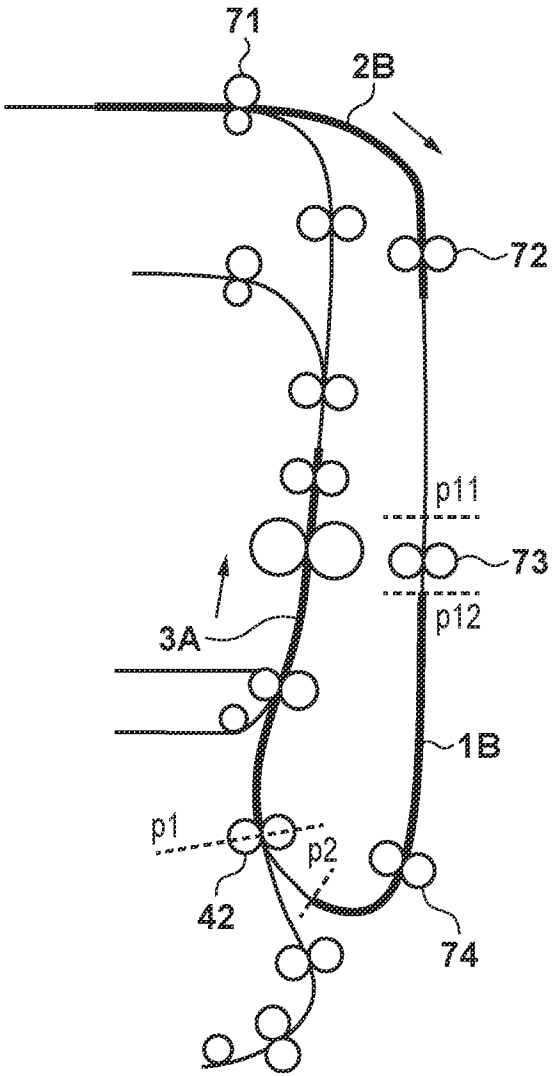

Next, the case of No in step S108 of FIG. 7 and Yes in step S201 of FIG. 8 and step S301 of FIG. 9 will be described. FIG. 12A is a view of immediately prior to reaching the sheet arrangement of FIG. 10A. Writing of the image of the second surface of the sheet 1B has not been permitted (No in step S108), and downstream stop processing (FIG. 9) is executed for the sheet 1B. The sheet 2B which is subsequent to the sheet 1B is present. Accordingly, the CPU 201, as illustrated in FIG. 12B, causes conveyance of the sheet 1B to stop in a state in which the leading end of the sheet 1B has reached the second stop position p2. The CPU 201, in the upstream stop processing corresponding to the subsequent sheet 2B in this state, stands by (step S304) until the double-sided motor drive start position p11 reach notification is issued (step S203). Note that the conveyance processing of the sheet 2B and the sheet 3A continues.

Figure 12C:
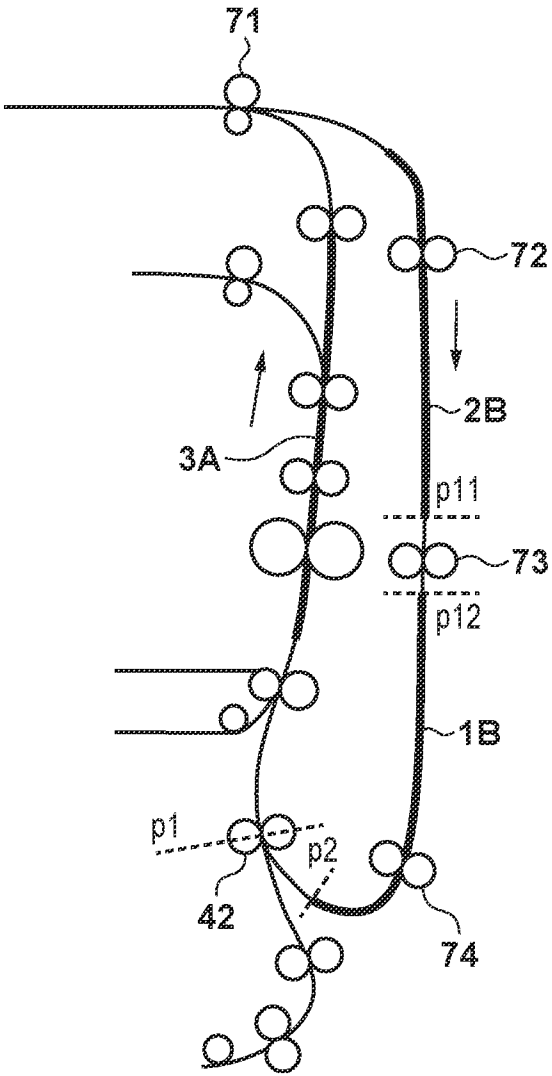
Figure 13A:
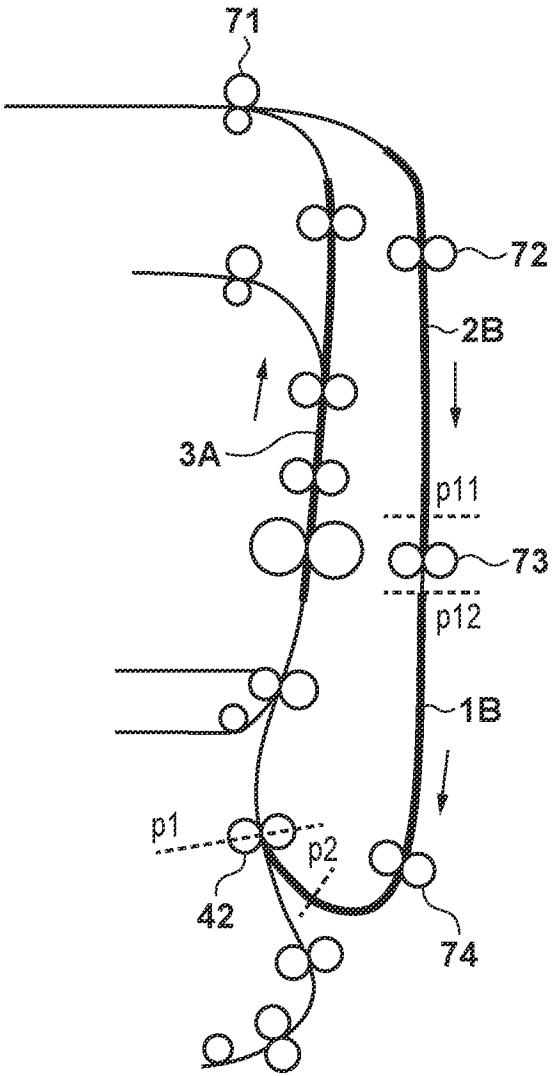
FIGS. 13A to 13C are views for describing a sheet conveyance when stop processing is needed according to an embodiment.
Figure 13B:
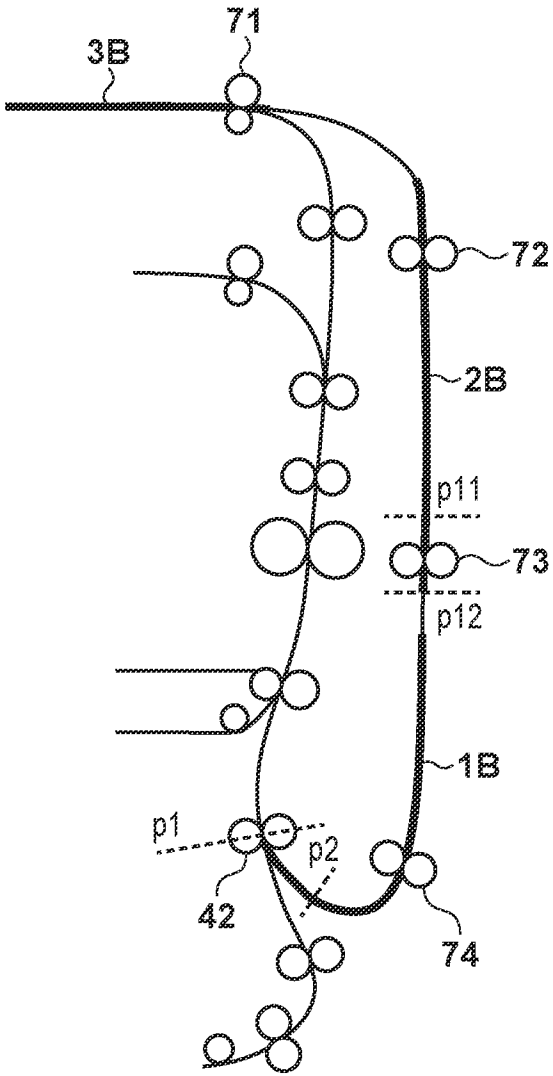
Figure 13C:
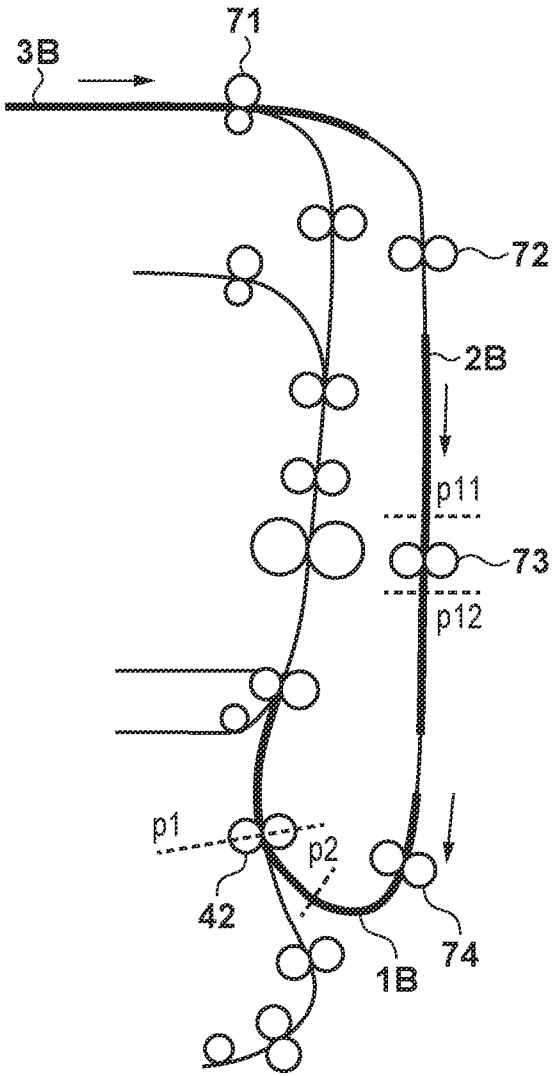

FIG. 12C indicates a situation in which the leading end of the sheet 2B has reached the double-sided motor drive start position p11. Upon the sheet 2B reaching the double-sided motor drive start position p11, the CPU 201 starts driving of the double-sided motor 180 (step S305). As illustrated in FIG. 13A, by the double-sided motor 180 being driven, the sheet 1B is conveyed by the double-sided roller 74. Also, the sheet 2B, after being nipped by the double-sided roller 73, is conveyed by the double-sided roller 73. When the time T1 elapses from the start of driving of the double-sided motor 180, driving of the reverse motor 170 and the double-sided motor 180 is stopped (step S205 and step S307). At this time, the leading end of the sheet 1B is positioned at the first stop position p1, and the leading end of the sheet 2B is nipped by the double-sided roller 73. Note that the conveyance of the sheet 3B is continued by the reversing roller 71 until the trailing end thereof is nipped, and a stop state in which the trailing end is nipped is entered. FIG. 13B illustrates this state, and three sheets are stopped in the reversing region and the double-sided conveyance path 70. When, after a predetermined duration has elapsed, writing of the image of the sheet 1B is permitted (Yes in step S308), driving of the double-sided motor 180 is started (step S309), and as illustrated in FIG. 13C, conveyance of both the sheet 1B and the sheet 2B is started.

Next, a method of setting the first stop position p1, the second stop position p2, the double-sided motor drive start position p11, and the upstream stop position p12 will be described. First, for the first stop position p1, the position of the registration roller 42 or a predetermined position that is on the upstream side of the registration roller 42 and on the downstream side of the double-sided roller 74 in the double-sided conveyance path 70 can be set. In the present embodiment, the first stop position p1 is made to be the position of the registration roller 42. Note that in the case of setting the first stop position p1 to the position of the registration roller 42, the conveyance of the sheet is stopped, forming a loop for correcting skewing.

Figure 14:
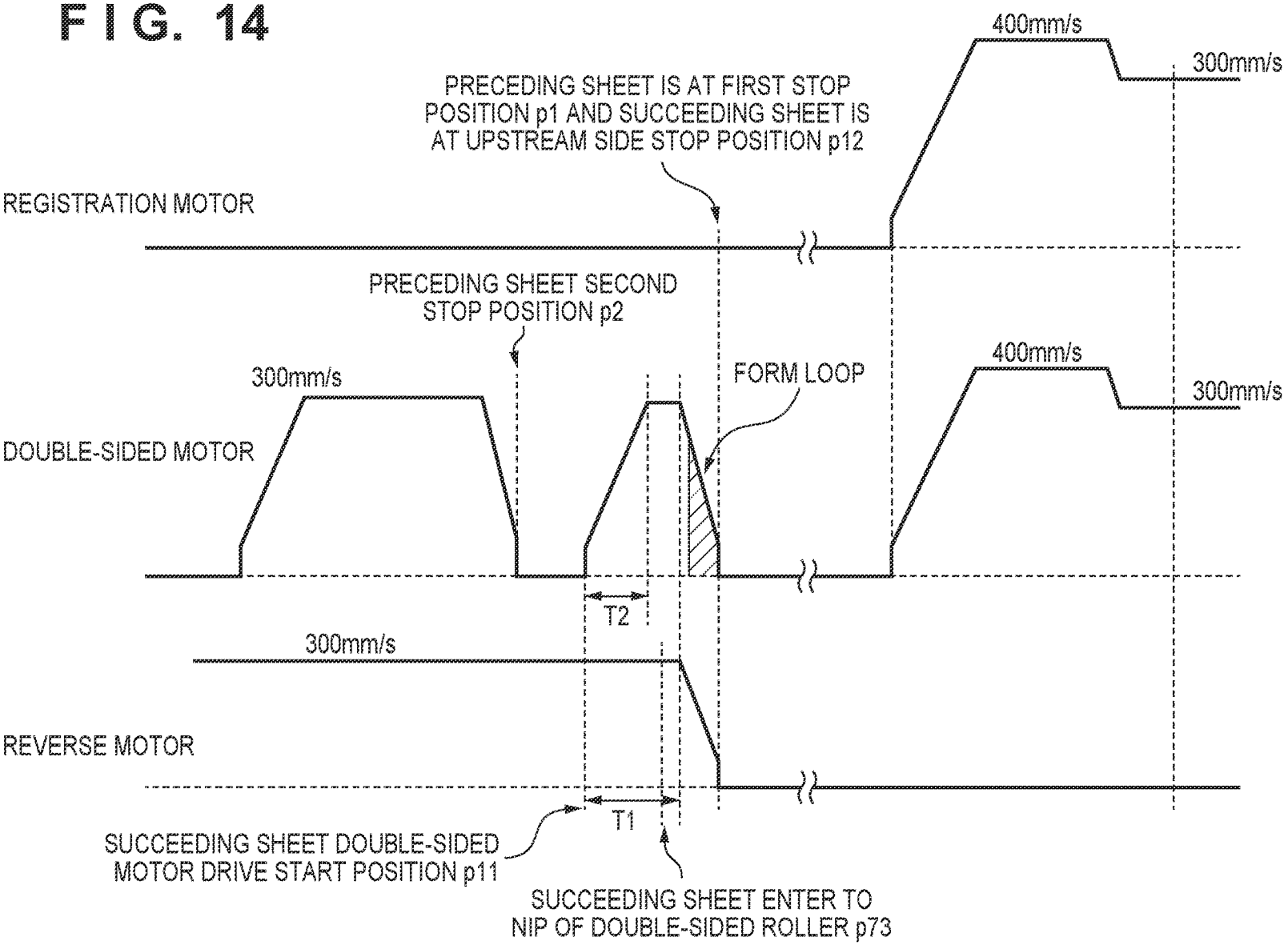
FIG. 14 is a motor driving line view when stop processing is needed according to an embodiment.

The double-sided motor drive start position p11 is set so that a distance that the sheet being conveyed by the reversing roller 71 is conveyed during the time T2 is shorter than the distance between the double-sided motor drive start position p11 and the position of the double-sided roller 73. Note that the time T2, as illustrated in FIG. 14, is the time that it takes for the stopped double-sided motor 180 to reach the sheet receiving speed. Next, the double-sided motor driving time T1 is decided. This time T1 is a time that is longer than the time it takes for a sheet whose leading end reached the double-sided motor drive start position p11 to be nipped by the double-sided roller 73. Upon deciding the time T1, the second stop position p2 and the upstream stop position p12 are determined in accordance therewith.

Specifically, in the case where the first stop position p1 is on the upstream side of the registration roller 42, a position a distance L1 upstream of the first stop position p1 becomes the second stop position p2. The distance L1 is a distance that a sheet is conveyed when time T1 passes after starting to drive the double-sided motor 180 from a stopped state, and from when stoppage of the double-sided motor 180 is started until the double-sided motor 180 stops. Note that, as in the present embodiment, if the first stop position p1 is a position of the registration roller 42, the sheet is stopped with forming a loop as described above. Accordingly, in such a case, the second stop position p2 is positioned the distance (L1-L2) on the upstream side of the first stop position p1. Note that the distance L2 is conveyance distance necessary for the loop formation from when the sheet reaches the registration roller 42. Also, the upstream stop position p12 is positioned the distance L3 on the downstream side on the double-sided motor drive start position p11 of the double-sided motor 180. Here, the distance L3, as illustrated in FIG. 14, corresponds to a distance that the sheet is conveyed over the time T1 at predetermined conveyance speed by the reverse motor 170 and the distance the sheet is conveyed during the time from when after that it starts to stop until it stops.

The two stop positions for preceding sheets in the double-sided conveyance path 70 and the position that the leading end of the subsequent sheet, which triggers driving of the double-sided motor 180 to start, reaches are set accordingly. Thereby, the preceding sheet is stopped at a stop position at which it does not interfere with the main conveyance path in which image transfer and fixing are performed, and it is possible to stop the subsequent sheet in a state in which its leading end is nipped in the double-sided roller 73. Accordingly, it is possible to convey two sheets with one double-sided motor 180 when conveyance after stopping is resumed. In this state, it is possible to convey a sheet subsequent to the succeeding sheet by the reverse motor 170. In other words, conveyance control can be performed by two motors for three sheets, the number of motors is reduced, and a cost reduction in the configuration of the conveyance is achieved.

Note that specific numerical values are indicated in the motor driving line views of FIG. 11 and FIG. 14, but the present invention is not limited to these specific numerical values. Also, in FIG. 11, in the registration roller 42, the loop is formed without stopping the sheet conveyance, and thereafter, the conveyance speed is increased, but it is also possible to configure so as to stop the sheet conveyance. Also, in a case where the first stop position p1 is set on the upstream side of the registration roller 42, after starting conveyance from the first stop position p1, the loop is formed. Note that in the case where the length of the preceding sheet conveyance direction is longer than the distance between the second stop position p2 and the double-sided motor drive start position p11, there is the possibility that the subsequent sheet will catch up with the trailing end of the preceding sheet and collide with it. Accordingly, in such a case, it is possible to configure so as to not execute the foregoing control and reduce the number of sheets that are stopped.

By the above configuration, it is possible to reduce the number of driving sources for driving conveyance rollers to less than the number of stopped sheets between the reversing roller 71 and the double-sided conveyance path 70.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-223054, filed on Nov. 20, 2017, which is hereby incorporated by reference herein in its entirety.

What is claimed is:

1. An image forming apparatus, comprising:

an image forming unit configured to form an image on a sheet;

a first roller configured to feed a sheet, on one surface of which an image was formed by the image forming unit, to a double-sided conveyance path for forming an image on another surface opposite to the one surface of the sheet;

a second roller positioned downstream of the first roller in a conveyance direction of the double-sided conveyance path;

a third roller positioned downstream of the second roller in the conveyance direction of the double-sided conveyance path;

a fourth roller positioned downstream of the third roller in the conveyance direction of the double-sided conveyance path;

a fifth roller configured to convey the sheet to an image forming position of the sheet by the image forming unit at a time of image formation on the one surface, the fifth roller being positioned downstream of the fourth roller in the conveyance direction of the double-sided conveyance path at a time of image formation on the other surface;

a first motor configured to drive the first roller and the second roller;

a second motor configured to drive the third roller and the fourth roller;

a driving force blocking unit configured to cause a driving force of the first motor to not be transferred to the second roller; and a controller configured to control conveyance of the sheet, wherein the controller is further configured to:

after a trailing end of a first sheet conveyed by the third roller passes the third roller, control the second motor such that a leading end of the first sheet stops at a first stop position between the fourth roller and the fifth roller by the fourth roller, when a leading end of a second sheet conveyed by the second roller and subsequent to the first sheet reaches a position between the second roller and the third roller, control the second motor such that the leading end of the first sheet stopped at the first stop position is conveyed by the fourth roller towards a second stop position closer to the fifth roller than the first stop position and the second sheet is conveyed by the third roller, and after the second sheet is conveyed by the third roller, control the second motor such that the leading end of the first sheet stops at the second stop position and the leading end of the second sheet stops at a third stop position between the third roller and the fourth roller.

2. The image forming apparatus according to claim 1, wherein the driving force blocking unit is a one-way clutch.

3. The image forming apparatus according to claim 1, wherein the driving force blocking unit transfers the driving force of the first motor, which conveys the sheet in the conveyance direction of the double-sided conveyance path, to the second roller, and does not transfer the driving force of the first motor, which conveys the sheet in a direction opposite to the conveyance direction of the double-sided conveyance path, to the second roller.

4. The image forming apparatus according to claim 1, wherein a conveyance path that is from the first roller to the first roller again via the second roller, the third roller, the fourth roller and the fifth roller has a length equal to or longer than a length in which three letter size sheets can be stopped.

5. The image forming apparatus according to claim 1, wherein the third stop position is set so that, when driving of the first motor is stopped upon the leading end of the first sheet reaching the second stop position, the leading end of the second sheet is positioned on the downstream side of the third roller.

6. The image forming apparatus according to claim 1, wherein the controller is further configured to, in a case where, when the first sheet is being conveyed in the double-sided conveyance path, the second sheet is not to be conveyed on the double-sided conveyance path, not stop the first sheet at the first stop position.

7. The image forming apparatus according to claim 6, wherein the controller is further configured to, in a case where, when the first sheet is being conveyed in the double-sided conveyance path, the second sheet is not to be conveyed on the double-sided conveyance path, not stop the first sheet at the first stop position, and stop driving of the second motor after the leading end of the first sheet reaches the second stop position.

8. The image forming apparatus according to claim 1, wherein the controller is further configured to, in a case where a third sheet subsequent to the second sheet is to be conveyed on the double-sided conveyance path, after the leading end of the second sheet has reached a position of the third roller, convey the third sheet in a direction opposite to the conveyance direction of the double-sided conveyance path by the first roller.

9. The image forming apparatus according to claim 1, wherein the second stop position is a position where the first sheet abuts the fifth roller.

* * * * *